US005199373A

United States Patent [19]

Mardikian

[11] Patent Number: 5,199,373

[45] Date of Patent: Apr. 6, 1993

[54] HULL CONFIGURATION FOR JET SKIS

[75] Inventor: Albert A. Mardikian, Corona del Mar, Calif.

[73] Assignee: Mardikian Family Investors, Corona del Mar, Calif.

[21] Appl. No.: 821,223

[22] Filed: Jan. 16, 1992

[51] Int. Cl.[5] ..... B63B 1/32

[52] U.S. Cl. ..... 114/288; 114/290

[58] Field of Search ..... 114/56, 67 R, 67 A, 114/57, 270, 271, 288, 290

[56] References Cited

U.S. PATENT DOCUMENTS 2,965,061 12/1960 Bank et al. ..... 114/56
3,216,389 11/1965 Thorsen ..... 114/56
4,492,176 1/1985 Arima ..... 114/271
4,722,294 2/1988 Bruning ..... 114/290
4,760,810 8/1988 Kobayashi ..... 114/56

*Primary Examiner*—Jesûs D. Sotelo
*Attorney, Agent, or Firm*—Harold L. Jackson

[57] ABSTRACT

A jet ski hull has a lower section formed with a pronounced and sharp leading keel portion defined by oppositely disposed curvilinear fluted side walls extending downwardly from the peripheral edge. The leading keel portion expands outwardly to define a central longitudinal flat bottom which divides each of the fluted side walls. A fluted longitudinal groove is formed along the outer edge of each of the fluted side walls, starting approximately at a point rearward of where the leading keel begins to flatten out.

23 Claims, 3 Drawing Sheets

HULL CONFIGURATION FOR JET SKIS

FIELD OF THE INVENTION

The present invention relates generally to jet ski hulls and more particularly to an improvement to the configuration of the bottom surface of a jet ski, wherein the water-engaging surface is formed so as to generate a suction action by means of the rearward water flow through a multiplicity of longitudinal flow channels that will establish a more stabilized condition for the jet ski as it moves at low speeds.

DESCRIPTION OF THE PRIOR ART

Various problems and difficulties are being encountered in maintaining a jet ski in a stabilized mode of operation when the jet ski is started up or traveling at low speeds of between 10 to 20 miles per hour.

Many types and configurations of jet ski hull structures have been devised to overcome this problem of instability as well as to overcome some existing problems due to the inherent lack of maneuverability of jet skis at low speeds. Accordingly, there are many restrictions and limitations in present hull configurations, causing difficulty in the operation of jet skis, not only when making low-speed maneuvers while turning, but also causing loss of control by skidding when cornering, thereby making high speed sharp turns difficult for all but the most highly skilled rider.

Generally, the lower section of the hull of prior art jet skis is arranged to ride in the water and conventionally has a pair of side walls extending vertically downward from the peripheral edge and a central portion extending between the side walls. The central portion in the prior art jet vehicle often has a lightly contoured convex surface.

However, there are several prior art jet skis that are formed with a blunt bow section which tends to push water over the bow up and away from the surface of the water. This type of bow tends to cause a loss of control as well as an unstable condition for the average joy rider An extended blunt or rounded downwardly formed nose at the bow will create back splash of water over the bow and onto the rider of the vehicle. These and other inherent shortcomings of the existing jet skis are overcome by the present invention which is directed to a unique improved configuration of the lower water engaging surface of the hull structure.

The central portion of the lower hull section is provided with a ride plate that extends below the pump. The pump receives water through a water inlet opening forward of the ride plate and exhausts the water at high velocity from a water outlet opening in the stern.

Generally, the lower section of the hull of the prior art jet skis is arranged to ride in the water and conventionally has a pair of side walls extending vertically downward from the peripheral edge and a central portion extending between the side walls. The central portion in the prior art jet skis often has a slightly contoured convex surface.

Reference can be made to several issued patents relating to jet ski and boat hulls and some are indicated as follows: U.S. Pat. No. 3,148,652 to H. D. Canazzi, *Planing Type Boat Hull:* U.S. Pat. No. 3,930,455 to Harry Bremer, *Boat Hull Construction:* U.S. Pat. No. 3,982,497 to Charles A. Caron, *Jet-Propelled Power Boat;* U.S. Pat. No. 4,004,542 to William H. Holmes, *Waterjet Propelled Planing Hull;* U.S. Pat. No. 4,492,176 to Juichi Arima, *Boat Hull,* and U.S. Pat. No. D-286,629 to Toshiro Suzuki Kobve, *Motorboat.*

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiments of the invention.

SUMMARY AND OBJECTS OF THE INVENTION

A jet ski hull that is defined by an upper section and a lower section, wherein the two hull sections are joined together along a peripheral edge. The edge is arranged to extend above the normal water line. In accordance with the present invention, the lower hull section defines a water-engaging surface that starts high up on the bow of the lower section of the hull and is formed having a very pronounced and a substantially sharp leading keel portion defined by oppositely disposed curvilinear fluted side walls that extend downwardly from the peripheral edge and rearwardly to the stern thereof The leading keel portion expands outwardly to define a central longitudinal flat bottom which divides each of the oppositely disposed curvilinear side walls having a reduced width.

The curvilinear configuration of the side walls cause the engaging waters to rotate more than 180 degrees at a very high velocity which in turn creates a vacuum to pull the bow of the hull down and in contact with the water. A corresponding fluted longitudinal groove is formed along the outer edge of each of the fluted side walls, starting approximately at a point rearward of where the leading keel begins to flatten out. Both the fluted side wall and the fluted groove define a pair of contiguous channels that extend substantially the length of the hull for channeling water therethrough to keep the entire hull in the water and to further prevent the hull from skidding during turns There is also formed adjacent the bow of the hull, a double fluted groove which provides a means to assist in the control of the vehicle.

In another embodiment a portion of the fluted walls are provided with dimples or surface depressions to create an additional suction action between the hull and the surface of the water.

BRIEF DESCRIPTION OF THE DRAWINGS

Novel features and advantages of the present invention, in addition to those mentioned above, will become apparent to those skilled in the art form reading the following detailed description in conjunction with the accompanying drawings and numbered parts wherein.

DETAILED DESCRIPTION OF THE PREFERRED EMBODIMENT

Figure 1:
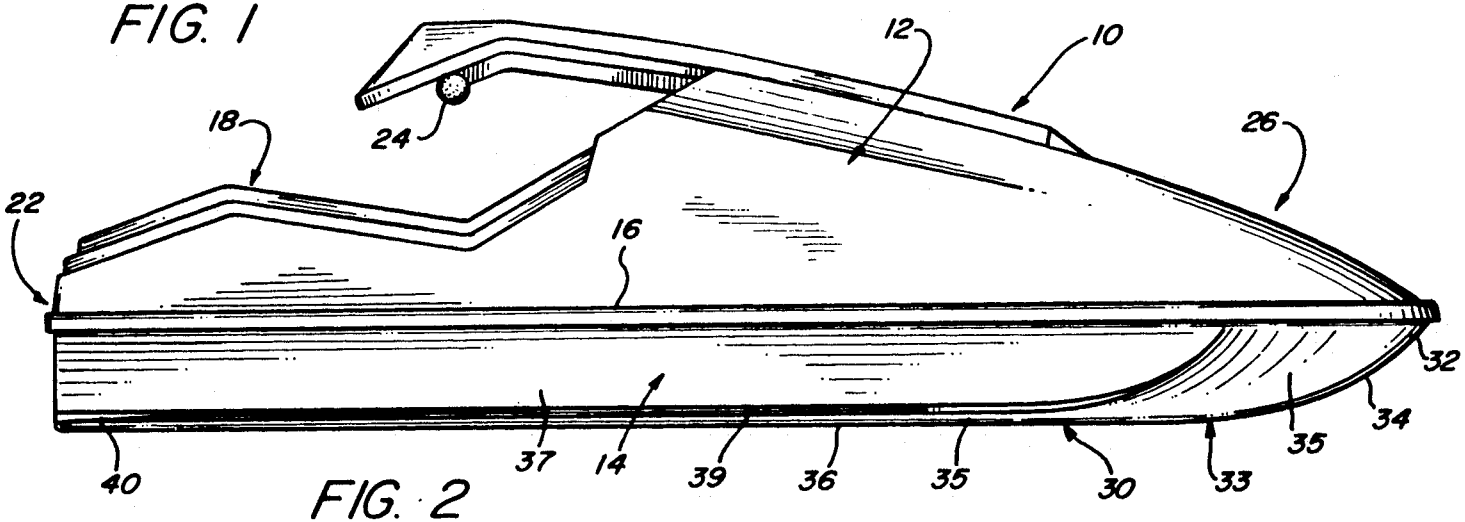
FIG. 1 is a side-elevational view of the jet ski.
Figure 2:
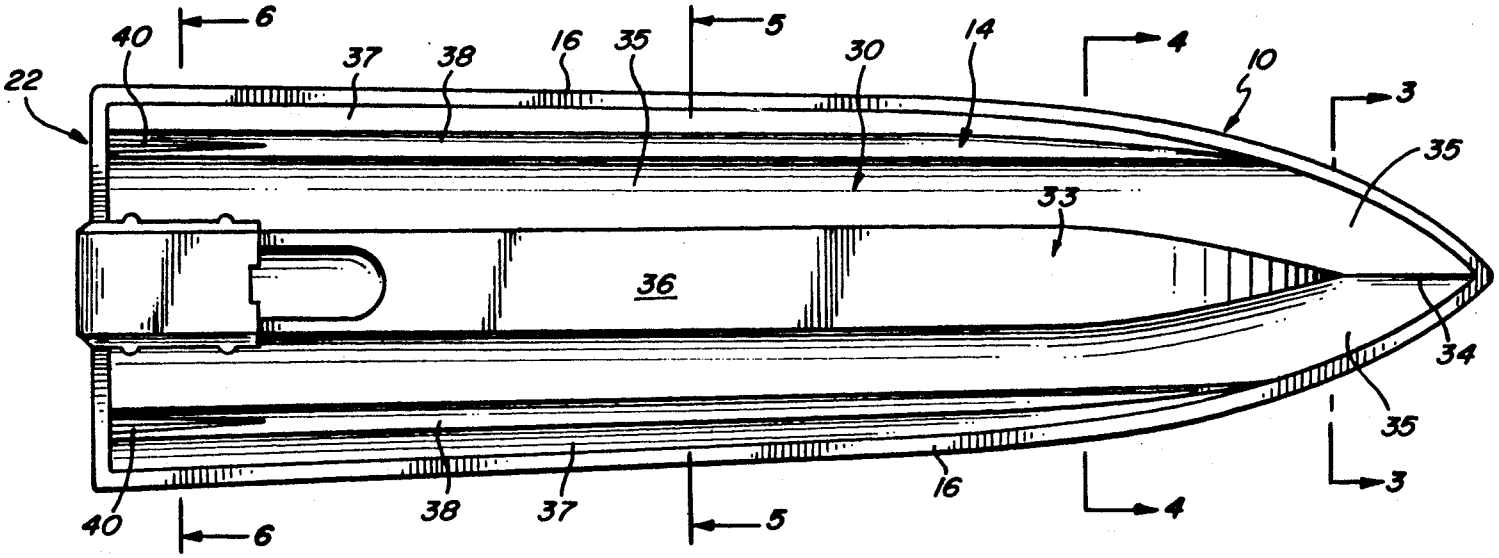
FIG. 2 is a bottom plan view showing the lower hull section of the jet ski of FIG. 1.

Referring now to the drawings and more particularly to FIG. 1, there is illustrated a jet ski vehicle, generally indicated at 10, which is defined by a hull that includes an upper hull section 12 and a lower hull section 14 which are joined along a peripheral edge 16. The upper hull section includes a body support portion, indicated at 18, at the rear of the upper hull section and extends forwardly from the stern 22 to approximately one-third the length of the hull. A handle bar member 24 is pivotally mounted near the bow 26 and is arranged to be grasped by the rider for balance and control purposes, as is well known in the art. The peripheral edge 16 forms a means to inhibit water from being forced over the bow and onto the rider at high speeds.

Referring now to FIGS. 2 through 6, the lower hull section is more specifically illustrated so as to define the novel arrangement and configuration of the water engaging surface, indicated generally at 30, formed in lower hull section 14, the lower hull section begins at the uppermost leading portion of bow 32 and forms a central keel arrangement, indicated generally at 33. The bow portion of keel 33 is formed having a very pronounced leading edge portion 34 which is defined by oppositely disposed concave curvilinear fluted side walls 35. Keel 33 and fluted walls 35 extend downwardly from peripheral edge 16 at the forward bow portion 32 and extend rearwardly to stern 22 of lower hull 14. This is more readily seen in the bottom view of FIG. 2. The leading edge 34 of the keel expands outwardly to define a central longitudinally flat bottom section 36 that extends more than three fourths of the length of the lower hull section 14. The central keel section 33 divides the oppositely disposed concave curvilinear side walls 35. The width "W" of flat bottom section 36 increases from approximately 0.825 inches at its front end to approximately 6.250 inches at its terminating end. Accordingly, the width of the flat bottom section 36 determines the overall width of each of the fluted walls 35 Thus, it can be seen that fluted walls 35 become smaller in width as the leading keel portion 34 starts to widen at the lower area of the bow section.

Figure 3:
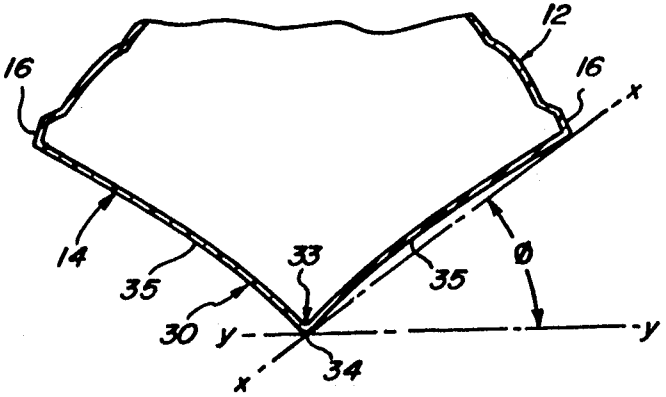
FIG. 3 is a cross-sectional view taken substantially along line 3—3 of FIG. 2.
Figure 6:
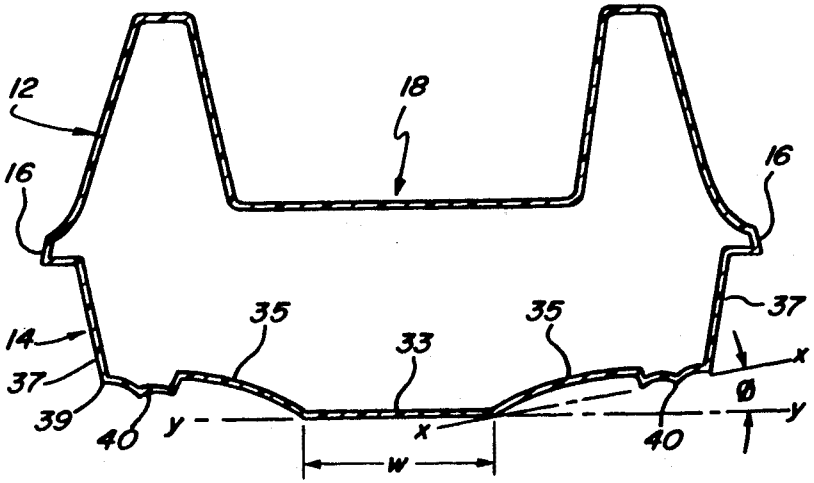
FIG. 6 is a cross-sectional view taken substantially along line 6—6 of FIG. 2.

The cross-sectional view of FIG. 3 illustrates the front lower bow 32 as having a deep substantially "V"-shaped configuration defined by the curvilinear walls 35. This configuration causes the water to impinge on fluted walls 35, thereby forcing the water to rotate or spin 360 degrees at a very high velocity which in turn creates a vacuum between the surface of the hull and the surface of the water. The vacuum generates a suction action that pulls the bow of the hull down in contact with the water. This action creates a stabilizing effect on a jet ski vehicle that has been heretofore unobtainable. In the cross-section shown in FIG. 3, fluted walls 35 are angularly disposed to that of the horizontal transverse plane y—y, whereby angle $\phi$ is defined by a horizontal transverse plane y—y and the angular line x—x that extends between the peripheral edge 16 of the bow and the leading keel section 34. As each fluted wall 35 extends rearwardly angle $\phi$ changes. That is, angle $\phi$ of fluted walls 35, from the front lower bow 32 rearward to the point where a parallel smaller fluted groove 38 begins, can range between about 40 to 34 degrees as the fluted walls extend toward the stern of the hull. Preferably, the angle as shown in FIG. 3 should be in the approximate range of 38 degrees at this point on the hull.

Figure 4:
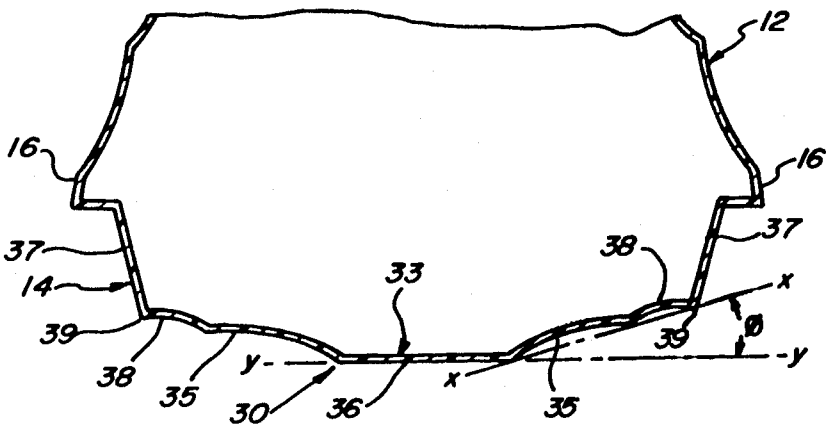
FIG. 4 is a cross-sectional view taken substantially along line 4—4 of FIG. 2.
Figure 5:
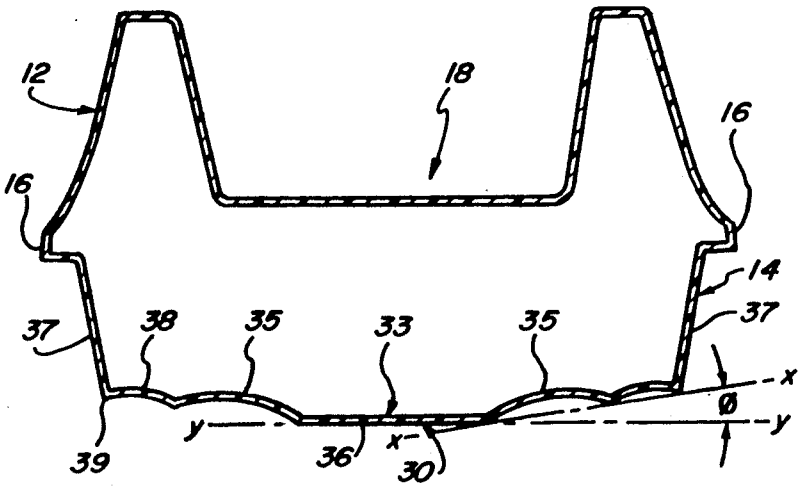
FIG. 5 is a cross-sectional view taken substantially along line 5—5 of FIG. 2.

As angle $\phi$ progressively decreases, rearwardly inclined side walls 37 are formed, as illustrated in FIGS. 4 and 5. As further noted in FIGS. 4 and 5, a smaller corresponding fluted longitudinal groove 38 is formed within fluted wall 35 adjacent the outer lower edge 39 of side walls 37. Both the fluted side wall and fluted groove define a pair of contiguous channels that extend substantially the length of the water engaging surface 30 of hull section 14. As the jet ski moves forward, the water is channeled therethrough the full length of surface 30, whereby the entire hull is in total contact with the water and thus further preventing the hull from skidding during turns. It should be noted that angle $\phi$ defined by line x—x and transverse plane y—y decreases as the fluted channels 35 and 38 extend longitudinally rearward from the bow. The angular position of the contiguous fluted channels will progressively decrease from the range of approximately 33 degrees to 7 degrees.

There is also formed adjacent the stern of the hull a double fluted groove 40 which provides a means to assist in the control of the stern of the jet ski vehicle 10.

Figure 7:
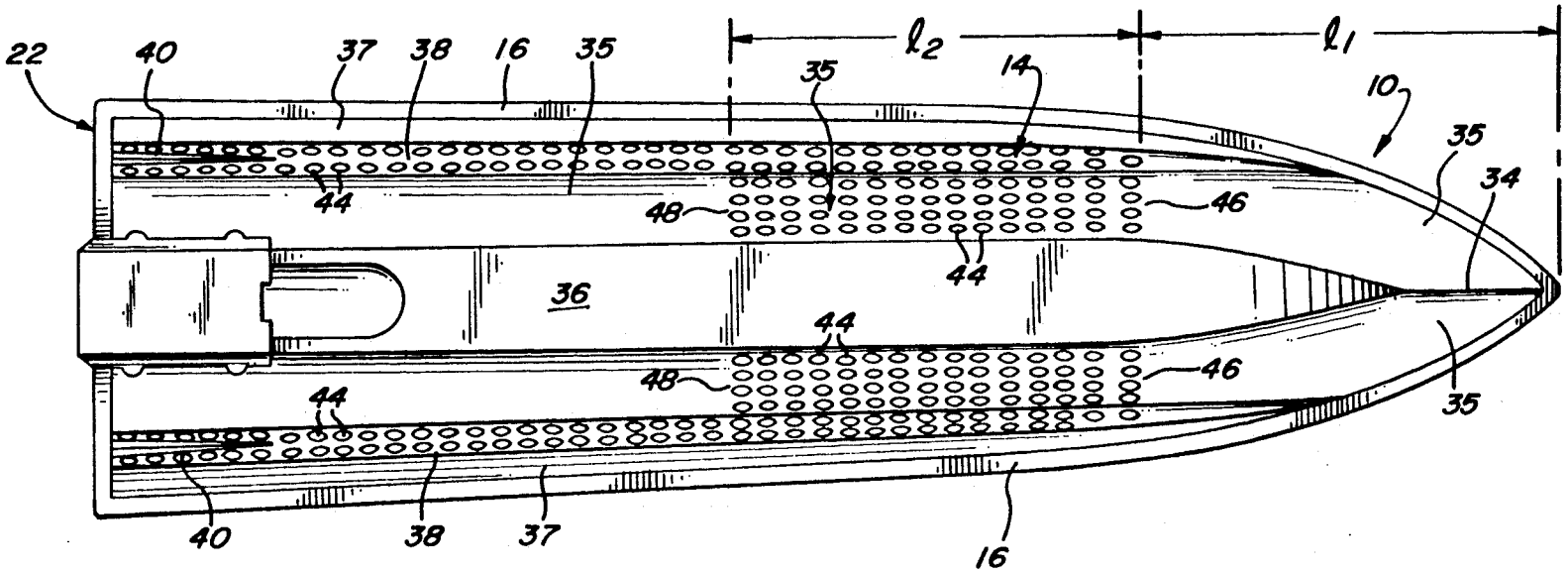
FIG. 7 is a bottom plan view showing the lower hull section of another embodiment of the jet ski in which the surface of certain sections thereof are dimpled.

FIG. 7 illustrates a surface treatment which may be used over a portion of the hull to create additional suction to hold the hull against the water surface. Specifically, portions of the fluted walls 35 and the fluted grooves 38 therein may be provided with dimples or surface depressions 44. The dimpled portions preferably commence rearward of the bow along a lateral position 46 so that the distance $l_1$ from that position to the bow 32 is approximately ¼ to ⅛ of the length of the hull. The dimoles extend on the surface of the fluted walls from position 46 to position 48 which is just beyond the midsection of the hull or for a length $l_2$ which is about ¼ of the hull length. With respect to the fluted grooves, the dimples extend all the way to the stern 22 as illustrated.

Figure 9:
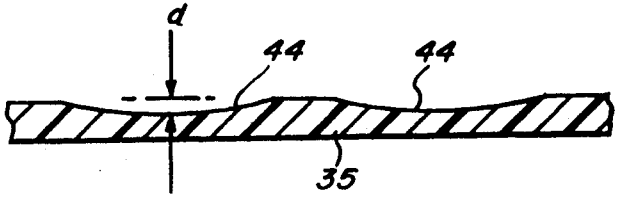
FIG. 9 is a cross-sectional view taken along lines 9—9 of FIG. 8.
Figure 8:
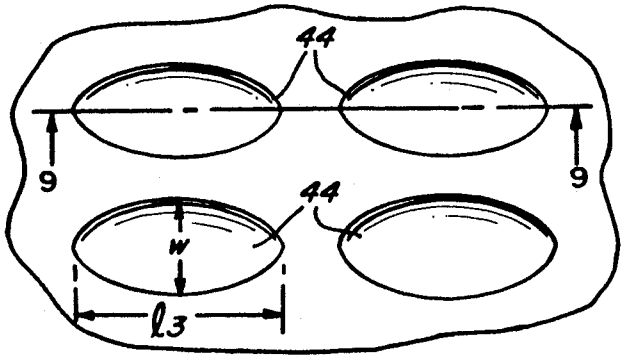
FIG. 8 is an enlarged plan view of a portion of the dimpled section of FIG. 7.

Referring to FIGS. 8 and 9, the dimples 44 have a preferably oval eliptical shape with pointed ends as illustrated. The dimples have (1) a length $l_3$ within the range of about ¾ of an inch to 1½ inches and preferably about 1 inch, and (2) a width w within the range of about ½ inches to 1 inch and preferably about ¾ of an inch. The depth d of the dimples is preferably within the range of about 1/10 of an inch to ¼ of an inch and most preferably about ⅛ of an inch. The dimples not only aid in holding the hull against the water but also appear to reduce the total wetted surface area and lower the frictional resistance. The dimples also appear to aid in maintaining the ski on a desired track.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. In a jet skill hull defined by an upper hull section and a lower hull section joined along a peripheral edge and having a bow and stern, wherein the lower hull section includes an improvement comprising:

a central longitudinal keel member formed in the lower hull section extending from the bow rearwardly to the stern of the lower hull section, whereby a bow portion and a trailing bottom portion are defined, wherein said bow portion of said keel is formed having a leading edge which extends downwardly from the peripheral edge, and wherein said trailing bottom portion is formed having a substantially flat surface terminating adjacent the stern of said lower hull section;

a pair of oppositely disposed symmetrical concave curvilinear fluted walls extending horizontally and substantially the length of said lower hull section so as to define said central keel, and wherein the forward portion of said concave curvilinear fluted walls form the bow portion of the lower hull section and said leading edge of said bow portion of said keel;

a pair of side walls joined along the lower portion of the peripheral edge extending substantially the length of the hull beginning rearwardly of the bow portion and terminating at the stern of the lower hull section, said side walls extending downwardly and inwardly from the peripheral edge for engagement with respective concave curvilinear fluted walls;

an elongated outer fluted groove formed within each of said concave curvilinear fluted walls so as to be positioned between said concave curvilinear fluted walls and adjacent the lower edge of each of said side walls substantially throughout the length thereof, whereby said hull is held down in contact with the water as the water impinges on the defined surfaces of said respective fluted walls and fluted grooves so as to cause the water to spin at a high velocity, thereby generating a suction action between the bottom surface of the lower hull section and the surface of the water; and means to assist in controlling the skidding of said stern of said jet ski hull when said jet ski hull is subjected to a sharp turn, said skid control means being formed adjacent the terminating end of said stern, and wherein said skid-control means comprises a foreshortened double-fluted groove formed within the terminating end of each of said outer fluted grooves and positioned adjacent said respective side walls of the rearward portion of said stern.

2. The improvement as recited in claim 1, wherein said concave curvilinear fluted wall is angularly displaced to the horizontal transverse plane defined at a given point along said keel from the bow to the stern thereof.

3. The improvement as recited in claim 2, wherein said concave curvilinear fluted wall and said fluted groove together define a plurality of contiguous fluted channels.

4. The improvement as recited in claim 3, wherein the degree of angular displacement of said contiguous fluted channels is defined by an angular line x—x and a horizontal transverse plane as defined by plane line y—y, wherein the angle $\phi$ decreases as said contiguous fluted channels extend longitudinally rearward from the bow.

5. The improvement as recited in claim 4, wherein the angular displacement of said contiguous fluted channels progressively decreases from approximately 33 degrees to approximately 7 degrees as said channels extend rearwardly from the bow to the stern.

6. The improvement as recited in claim 1, wherein said bow portion extends downwardly and inwardly, forming a deep substantially V-shaped configuration, whereby a forward leading edge is defined so as to cause the engaging water to rotate at a high velocity, creating a vacuum between the surface of the hull and the surface of the water.

7. In a jet ski hull defined by an upper hull section and a lower hull section joined along a peripheral edge and having a bow and stern, wherein said lower hull section includes an improvement comprising:

a central longitudinal keel member formed in the lower hull section extending from the bow rearwardly to the stern of the lower hull section, whereby a bow portion and a trailing bottom portion are defined, whereby said bow portion of said keel is formed having a leading edge which extends downwardly from the peripheral edge, and wherein said trailing bottom portion is formed having a substantially flat surface terminating adjacent the stern of said lower hull section;

a pair of oppositely disposed, symmetrical, concave curvilinear fluted walls extending horizontally and substantially the length of said lower hull section so as to define said central keel, and wherein the forward portions of said concave curvilinear fluted walls form the bow portion of said lower hull section and said leading edge of said bow portion of said keel;

a pair of side walls joined along the lower portion of said peripheral edge extending substantially the length of said hull beginning rearwardly of said bow portion and terminating at the stern of said lower hull section, said side walls extending downwardly and inwardly from the peripheral edge for engagement with respective concave curvilinear fluted walls; and an elongated fluted groove formed within each of said concave curvilinear fluted walls so as to be positioned between said concave curvilinear fluted wall and adjacent the lower edge of each of said side walls substantially throughout the length thereof, whereby said hull is held down in contact with the water as the water impinges on the defined surfaces of said respective fluted walls and fluted grooves so as to cause the water to spin at a high velocity, thereby generating a suction action between the bottom surface of said lower hull section and the surface of the water; and wherein a portion of each of the fluted walls has surface depressions for interfacing with the water to create an additional suction action between the bottom surface of the lower hull section and the surface of the water.

8. The improvement recited in claim 7 wherein the depressions are oval shaped with a length within the range of about $\frac{3}{4}$ of an inch to $1\frac{1}{2}$ inches, a width within the range of about $\frac{1}{2}$ and inch to 1 inch and a depth within the range of about 1/16 of an inch to $\frac{1}{8}$ of an inch.

9. The improvement of claim 8 wherein the length, depth and width of each depression is about 1 inch, $\frac{3}{4}$ of an inch and $\frac{1}{8}$ inches, respectively.

10. The improvement recited in claim 8 wherein the portion of the portion of fluted walls provided with the surface depressions commences at a point about ⅓ of the length of the hull from the bow and terminates at about the mid-section of the hull.

11. The improvement recited in claim 10 wherein each of the elongated fluted grooves have surface depressions extending from the termination of the surface depressions in the fluted walls to the stern.

12. A jet ski hull formed by an upper hull section and a lower hull section joined along a peripheral edge and having a bow and stern, wherein the lower hull section is formed having an improved water engaging surface which defines means for stabilizing the jet ski hull at both low and high speeds and wherein the stabilizing means comprises:

a pair of symmetrically disposed concave curvilinear fluted wall members extending substantially the full length of the lower hull section, and wherein the forward portion of each of said concave curvilinear fluted wall members join along the opposite side of the bow portion of the peripheral edge thereof and extends downwardly and horizontally rearwardly therefrom along the full length of the water engaging surface forming at least one channel for directing a high velocity of spinning water therethrough so as to establish a stabilizing condition on both sides of the jet ski hull;

a central longitudinal keel member formed in the lower hull section extending from said bow portion of the peripheral edge rearwardly to the stern of the lower hull section, said keel being formed between said oppositely disposed concave curvilinear fluted wall members, wherein a bow portion of said keel is formed having a leading edge which extends downwardly from the peripheral edge, and wherein a trailing bottom portion is formed having a substantially flat surface terminating adjacent the stern of said lower hull section;

a pair of oppositely disposed side walls joined along the lower portion of the peripheral edge extending downwardly and inwardly along the length of the lower hull section starting rearwardly of said bow portion of said concave curvilinear fluted wall member and terminating at the stern of the lower hull section, the lower edge of each of said side walls being in engagement with each respective adjacent concave curvilinear fluted wall member along the full length thereof;

an elongated fluted groove formed within each of said concave curvilinear fluted wall members to define the outer edge of said concave curvilinear fluted wall members so as to be positioned between each of said concave curvilinear fluted wall members and said adjacent lower edge of each of said side walls, whereby said water engaging surface is held down in contact with the water by the suction action created as the water impinges on the surfaces of said respective fluted walls and fluted grooves, whereby the forward movement of said jet ski hull while in the water will create a high velocity spinning action, thereby generating a suction action between the water engaging bottom surface of the lower hull section so as to define a stabilizing means on both sides of the jet ski hull;

wherein said fluted side wall and fluted groove are integrally formed to define a pair of elongated contiguous channels that extend substantially the length of the water engaging bottom surface of the lower hull section; and means to assist in controlling the skidding of the stern of said jet ski hull when said jet ski hull is subjected to a sharp turn, said skid control means being formed adjacent the terminating end of the stern, and wherein said skid control means comprises a foreshortened double-fluted groove formed within the terminating end of each of said outer fluted grooves and positioned adjacent said respective side walls of the rearward portion of said stern.

13. The invention as recited in claim 12, wherein said concave curvilinear fluted wall member and said fluted grooves together define a plurality of contiguous fluted channels.

14. The invention as recited in claim 13, wherein the degree of angular displacement of said contiguous fluted channels is defined by the angular position of said fluted channels with respect to a horizontal transverse plane of the bottom of said keel, wherein the angle of said fluted channels decreases as said fluted channels extend longitudinally rearward of the bow.

15. The invention as recited in claim 13, wherein the angular displacement of said contiguous fluted channels progressively decreases from approximately 33 degrees to approximately 7 degrees as said channels extend rearwardly from the bow to the stern.

16. A jet ski hull formed by an upper hull section and a lower hull section joined along a peripheral edge and having a blow and stern, wherein said lower hull section is formed having an improved water-engaging surface which defines means for stabilizing the jet ski hull at both low and high speeds and wherein said stabilizing means comprises:

a pair of symmetrically disposed concave curvilinear fluted wall members extending substantially the full length of said lower hull section, and wherein the forward portion of each of said concave curvilinear fluted wall members is joined along the opposite side of said bow portion of the peripheral edge thereof, and extends downwardly and horizontally rearward therefrom along the full length of the water engaging surface, forming at least one channel for directing a high velocity of spinning water therethrough so as to establish a stabilizing condition on both sides of said jet ski hull;

a central longitudinal keel member formed in said lower hull section extending from said bow portion of the peripheral edge rearwardly to said stern of said lower hull section, said keel being formed between said oppositely disposed concave curvilinear fluted wall members, wherein a bow portion of said keel is formed having a leading edge which extends downwardly from the peripheral edge, and wherein a trailing bottom portion is formed having a substantially flat surface terminating adjacent said stern of said lower hull section;

a pair of oppositely disposed side walls joined along said lower portion of the peripheral edge extending downwardly and inwardly along the length of said lower hull section starting rearwardly of said bow portion of said concave curvilinear fluted wall member and termination at said stern of said lower hull section, the lower edge of each of said side walls being in engagement with each respective, adjacent, concave curvilinear fluted wall member along the full length thereof; and an elongated fluted groove formed within each of said concave curvilinear fluted wall members to define the outer edges of said fluted wall members, said grooves being positioned between each of said concave curvilinear fluted wall members and the adjacent lower edge of each of said side walls, whereby said water-engaging surface of held down in contact with the water by the suction action created as the water impinges on the surfaces of said respective fluted walls and fluted grooves, so that when in the water the forward movement of said jet ski hull will create a high-velocity spinning action, thereby generating a suction action between the water-engaging bottom surface of said lower hull section so as to define a stabilizing means on both sides of said jet ski hull; and wherein a portion of the fluted walls has surface depressions for interfacing with the water to create an additional suction action between the bottom surface of the lower hull section an the surface of the water.

17. The invention recited in claim 16 wherein the depressions are oval shaped with a length within the range of about ¾ of an inch to 1½ inches, a width within the range of about ½ and inch to 1 inch and a depth within the range of about 1/16 of an inch to ⅛ of an inch.

18. The invention of claim 17 wherein the length of each depression is about 1 inch, ¾ of an inch and 8 inches, respectively.

19. The invention recited in claim 18 wherein the portion of the portion of fluted walls provided with the surface depressions commences at a point about ⅓ of the length of the hull from the bow and terminates at about the mid-section of the hull.

20. In a jet ski hull defined by an upper hull section and a lower hull section joined along a peripheral edge and having a bow and stern, wherein the lower hull section includes an improvement comprising:

a central longitudinal keel member formed in the lower hull section extending from the bow rearwardly to the stern of the lower hull section, whereby a bow portion and a trailing bottom portion are defined, wherein said bow portion of said keel is formed having a leading edge which extends downwardly from the peripheral edge, and wherein said trailing bottom portion is formed having a substantially flat surface terminating adjacent the stern of said lower hull section;

a pair of oppositely disposed symmetrical curvilinear fluted walls extending horizontally and substantially the length of said lower hull section so as to define said central keel, and wherein the forward portion of said concave curvilinear fluted walls form the bow portion of the lower hull section and said leading edge of said bow portion of said keel;

a pair of side walls joined along the lower portion of the peripheral edge extending substantially the length of the hull beginning rearwardly of the bow portion and terminating at the stern of the lower hull section, said side walls extending downwardly and inwardly from the peripheral edge for engagement with respective concave curvilinear fluted walls; and a portion of the fluted walls having dimples for interfacing with the water to create a suction action between the bottom surface of the lower hull section and the surface of the water.

21. The improvement recited in claim 20 wherein the dimples are oval shaped with a length within the range of about ¾ of an inch to 1½ inches, a width within the range of about ½ and inch to 1 inch and a depth within the range of about 1/16 of an inch to ½ of an inch.

22. The improvement of claim 21 wherein the length, width and depth of each depression is about 1 inch, ¾ of an inch and ⅛ inches, respectively.

23. The improvement recited in claim 22 wherein the portion of the portion of fluted walls provided with the surface depressions commences at a point about ⅓ of the length of the hull from the bow and terminates at about the mid-section of the hull.

* * * * *

UNITED STATES PATENT AND TRADEMARK OFFICE

CERTIFICATE OF CORRECTION

PATENT NO. : 5,199,373

DATED : April 6, 1993

INVENTOR(S) : Mardikian

It is certified that error appears in the above-identified patent and that said Letters Patent is hereby corrected as shown below:

Column 9, line 7, "of" should read --is--.

Signed and Sealed this

Fourteenth Day of December, 1993

Bruce Lehman

*Attest:*

BRUCE LEHMAN

*Attesting Officer*

*Commissioner of Patents and Trademarks*